US007244098B2

(12) United States Patent
Bromann

(10) Patent No.: US 7,244,098 B2
(45) Date of Patent: Jul. 17, 2007

(54) DEVICE FOR ADJUSTING THE CENTERING OF A RING FOR SYNCHRONIZING THE CONTROL OF PIVOTING VANES IN A TURBOMACHINE

(75) Inventor: Alain Marc Lucien Bromann, Vulaines/Seine (FR)

(73) Assignee: SNECMA, Paris (FR)

( * ) Notice: Subject to any disclaimer, the term of this patent is extended or adjusted under 35 U.S.C. 154(b) by 0 days.

(21) Appl. No.: 11/355,883

(22) Filed: Feb. 17, 2006

(65) Prior Publication Data

US 2006/0193720 A1 Aug. 31, 2006

(30) Foreign Application Priority Data

Feb. 25, 2005 (FR) ..... 05 01931

(51) Int. Cl.
*F01D 17/16* (2006.01)

(52) U.S. Cl. ..... 415/160

(58) Field of Classification Search ..... 415/149.4, 415/159, 160, 162

See application file for complete search history.

(56) References Cited

U.S. PATENT DOCUMENTS

| | | | | |
|---|---|---|---|---|
| 4,812,106 | A * | 3/1989 | Purgavie | 415/160 |
| 4,826,399 | A | 5/1989 | Perez | |
| 4,925,364 | A * | 5/1990 | Das | 415/162 |
| 5,387,080 | A | 2/1995 | Bouhennicha et al. | |
| 5,700,129 | A * | 12/1997 | Kocian | 415/160 |

* cited by examiner

*Primary Examiner*—Richard A. Edgar
(74) *Attorney, Agent, or Firm*—Oblon, Spivak, McClelland, Maier & Neustadt, P.C.

(57) ABSTRACT

The invention provides a device for adjusting the centering of a control ring for pivoting vanes of a turbomachine, the device comprising a plurality of pads for coming into contact with a circular surface that is coaxial with the ring, each pivoting vane being connected to the control ring via a lever having a first end secured to the control ring via a crank pin disposed radially on said ring, and a second end mounted on a pivot of the vane, each of said pads being secured to a pad carrier. Each pad carrier is secured under the control ring by means of attachment systems that are designed to be assembled from over the ring.

17 Claims, 3 Drawing Sheets

DEVICE FOR ADJUSTING THE CENTERING OF A RING FOR SYNCHRONIZING THE CONTROL OF PIVOTING VANES IN A TURBOMACHINE

BACKGROUND OF THE INVENTION

The present invention relates to the general field of devices for adjusting a ring for synchronizing the control of pivoting vanes of a turbomachine, so that the ring is properly centered on the axis of the machine.

In a turbomachine, it is known to use one or more stages of stator vanes to adjust the flow and direction of the gas passing through the compression section as a function of the operating speed of the turbomachine. These stator vane stages comprise a plurality of vanes (referred to as "variable-pitch" vanes) capable of pivoting about their axes that connect them to the stator, in such a manner that their pitch angle can be modified as a function of the operating speed of the turbomachine.

Known devices for controlling variable-pitch vanes conventionally comprise a control member in the form of a ring surrounding the turbomachine casing and a plurality of levers or cranks, each lever having a first end connected to the control ring via a hinge and a second end mounted on the pivot of a respective vane. Synchronized modification of the angular position of the vanes is thus implemented by turning the ring about the axis of the turbomachine.

In order to improve the efficiency of turbomachines, it is necessary to increase the precision with which the pitch angle of the stator vanes is set. To do this, it is known to ensure that the ring controlling these vanes is accurately coaxial about a circular surface of the turbomachine such as its casing shell. This coaxial configuration is generally obtained by means of pads connected to the control ring by mounting devices and surrounding the casing with very little clearance.

The devices for mounting pads on the control ring must therefore enable pad position to be adjusted radially. Thus, U.S. Pat. No. 5,387,080 discloses a device for adjusting the coaxial position of a control ring by using pads whose radial positions are adjusted by screws having two threads, with their threaded portions having slightly different helical pitch angles.

With that type of device, it has been found that during the various operating stages of the turbomachine, some of the pads are no longer in contact with the casing, thus leading to vibration, causing the threads of the two-thread screw to be worn away completely. As a result it is no longer possible to adjust the clearance between the pads and the casing.

In addition, with that device, it is not possible to remove one or more pads without it being necessary to disassemble all of the parts of the variable-pitch vane stage, and in particular the control ring. Each pad is secured to a pad carrier provided with a rod that passes right through the ring and that is screwed into the ring from beneath it. Thus, because of the presence of the casing, it is not possible to remove the pad from beneath the ring.

OBJECT AND SUMMARY OF THE INVENTION

A main object of the present invention is thus to mitigate such drawbacks by proposing a device for adapting the centering of the ring that is simple, reliable, and that enables time to be saved during assembly and disassembly.

To this end, the invention provides a device for adjusting the centering of a control ring for pivoting vanes of a turbomachine, the device comprising a plurality of pads for coming into contact with a circular surface that is coaxial with the ring, each pivoting vane being connected to the control ring via a lever having a first end secured to the control ring via a crank pin disposed radially on said ring, and a second end mounted on a pivot of the vane, each of said pads being secured to a pad carrier, wherein each pad carrier is secured under the control ring by means of attachment systems that are designed to be assembled from over the ring.

The term "fastening under the control ring" is used to mean that the pad carrier is fastened against an inside surface of the ring. The term "assembled from over the control ring" is used to mean that the attachment systems are assembled from the outside of the ring.

The fastening of each pad carrier under the ring by using attachment systems assembled from over the ring enables the attachment systems to be removed from the outside of the ring. When it is desired to act on a pad, there is therefore no need to remove the control ring, together with all of the parts of the variable-pitch system. As a result it is much easier to mount and dismount the pads.

According to a particular characteristic of the invention, the device may further include means for adjusting the radial positions of the pads.

Thus, advantageously, the pad carrier includes a substantially tubular portion extending longitudinally from the control ring towards the inside thereof and suitable for receiving a complementary tubular portion of the pad, the device further including a screw for screwing into the tubular portion of the pad in such a manner as to enable the radial position of the pad to be adjusted.

According to another particular characteristic of the invention, the device may also include means for locking the pad against turning relative to the pad carrier.

According to another particular characteristic of the invention, the device may also include means for locking the screw in the pad.

Preferably, a spring is interposed between the tubular portion of the pad carrier and the tubular portion of the pad so as to provide damping for the pad on the circular surface.

Each pad carrier may be located as a radial extension of the crank pin of the vane with which it is associated. Under such circumstances, each pad carrier may advantageously be secured to the control ring by means of two attachment systems disposed symmetrically on either side of the crank pin of the vane with which it is associated.

Alternatively, each pad carrier may be offset angularly relative to the crank pin of the vane with which it is associated.

Preferably, each attachment system is constituted by a screw for screwing into the control ring from its outside together with a clamping nut.

BRIEF DESCRIPTION OF THE DRAWINGS

Other characteristics and advantages of the present invention appear from the following description given with reference to the accompanying drawings that show an embodiment having no limiting character. In the figures.

DETAILED DESCRIPTION OF AN EMBODIMENT

Figure 1:
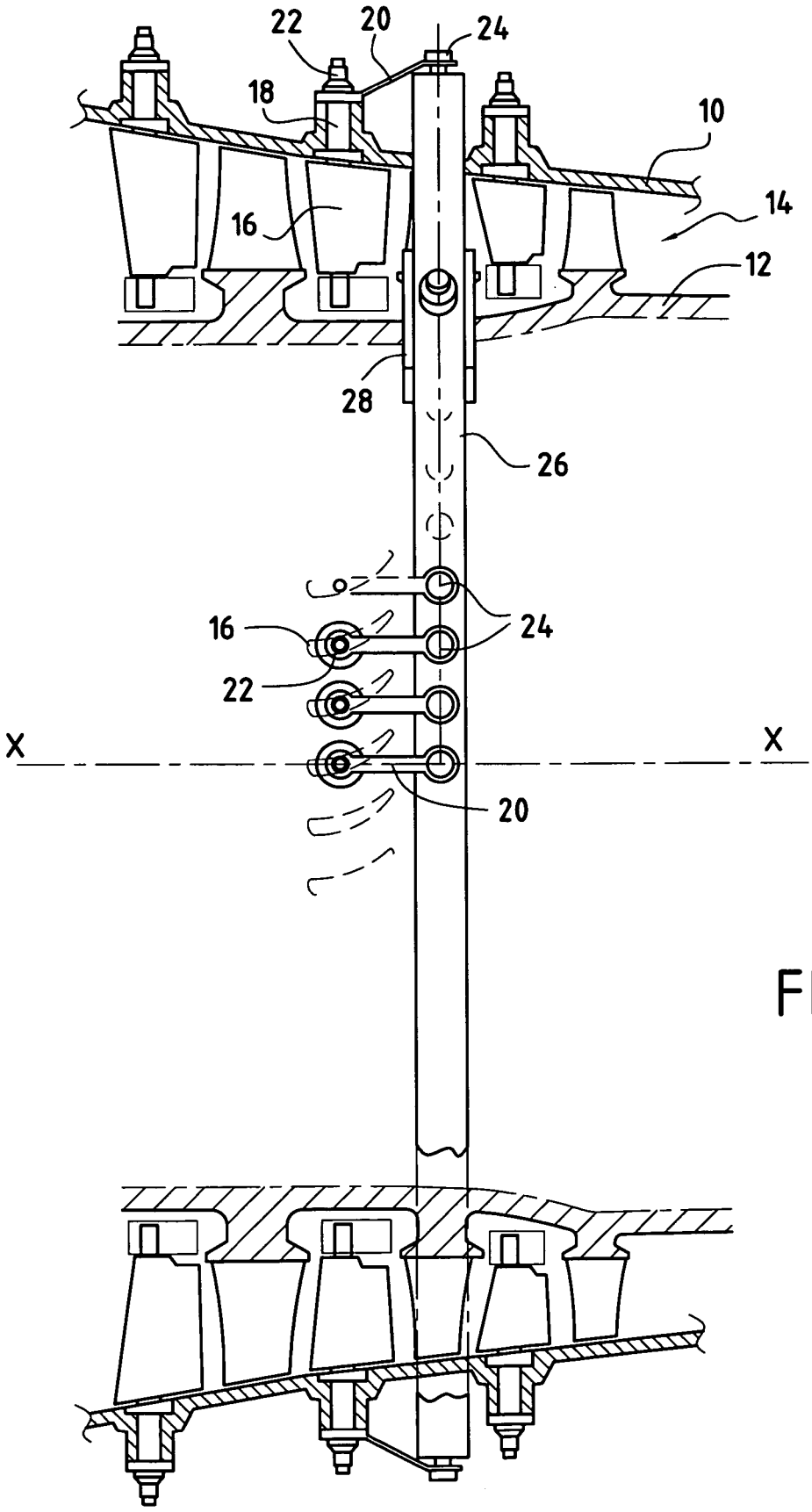
FIG. 1 is a diagram of a variable-pitch vane stage having a control ring.

FIG. 1 shows a portion of a compressor of a turbomachine of axis X-X. The compressor comprises an annular stator casing 10 centered on the axis X-X of the turbomachine, and surrounding an annular rotor 12 in such a manner as to define an annular gas-flow section 14.

The compressor further comprises a plurality of vanes forming a plurality of stages in the flow section 14, some of which are constituted using variable-pitch vanes 16. These variable-pitch vanes 16 are mounted to pivot about respective axes 18 passing through the stator casing 10.

Each axis (or pivot) 18 of a variable-pitch vane 16 is connected at one end to a control lever or crank 20 via an endpiece 22. The other ends of the levers 20 are hinged about cranks pins 24 disposed radially on a control ring 26 that surrounds a circular surface 28 centered on the axis X-X of the turbomachine and with which it must be coaxial.

The invention relates to a device enabling the centering of the control ring 26 to be adjusted relative to the axis X-X of the turbomachine. More precisely, such a device must be capable of maintaining constant radial spacing between the control ring 26 and the circular surface 28 that is centered on the axis X-X.

As shown in FIGS. 2 to 5, the device of the invention for adjusting the centering of the control ring 26 comprises in particular a plurality of pads 30 for coming into contact with the circular surface 28.

An embodiment of the device of the invention is described below with reference to FIG. 2.

Each pad 30 is secured to a pad carrier 32. The pad carrier 32 presents a substantially tubular portion 34 that extends longitudinally from an inside surface 26*a* of the control ring 26 towards the inside thereof. By way of example, the pad 30 is crimped to the free end of the tubular portion 34.

At its end remote from the pad 30, the tubular portion 34 of the pad carrier 32 is terminated by two fastening flanges 36 that come into contact with the inside surface 26*a* of the ring 26.

By means of these flanges 36, attachment systems 38, e.g. of the bolt type, enable the pad carrier 32 to be secured under the control ring 26. In the embodiment of FIG. 2, two screws 38*a* thus pass radially through the ring 26 and clamping nuts 38*b* are screwed onto the free ends of the screws so as to press against the fastener flanges 36 of the pad carrier 32.

Figure 2:
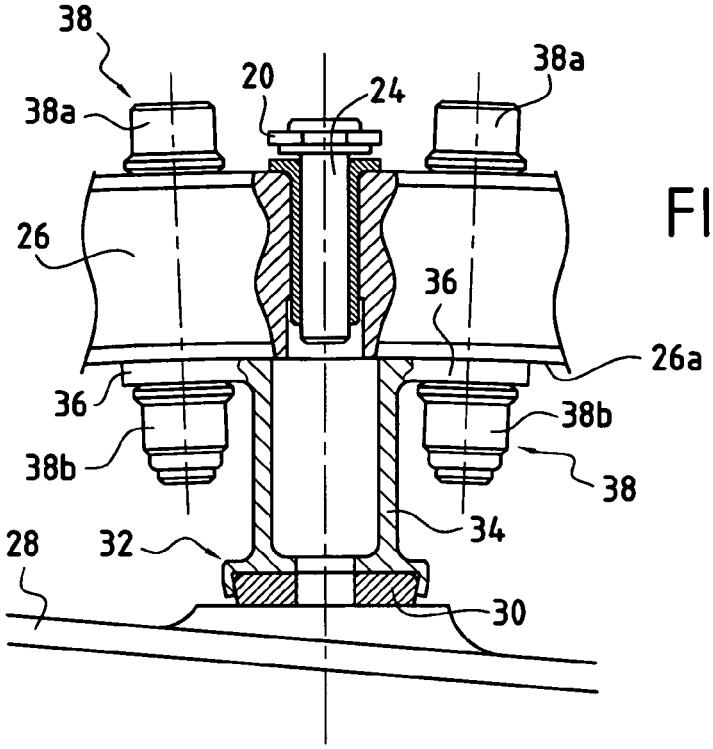
FIG. 2 is a section view of an adjustment device in an embodiment of the invention.

As shown in FIG. 2, the screws 38*a* of the attachment systems 38 are assembled from over the ring, i.e. from the outside towards the inside thereof, and the clamping nuts 38*b* are secured under the control ring 26.

It is thus easy to hold on the clamping nuts 38*b* from under the ring and to unscrew the screws 38*a* from over the ring without it being necessary to dismantle the control ring and the parts secured thereto. As a result, the pad carrier 32 can be removed merely by acting on its attachment systems and without it being necessary to act on the control ring.

As shown in the example of FIG. 2, the pad carrier 32 can be located radially in line with the crank pin 24 of the vane with which it is associated. Under such circumstances, the pad carrier 32 is advantageously secured under the control ring 26 using two attachments systems 38 that are disposed symmetrically on either side of the crank pin 24 of the associated vane.

Alternatively, in a variant not shown in the figures, the pad carrier may be offset angularly relative to the crank pin of the vane with which it is associated.

In the embodiment of FIG. 2, it can also be seen that the radial position of the pad 30 relative to the circular surface 28 is not adjustable. This solution thus requires very good control over the dimensional tolerances of the parts making up the device in order to ensure operating clearance between the pad and the circular surface.

Figure 3:
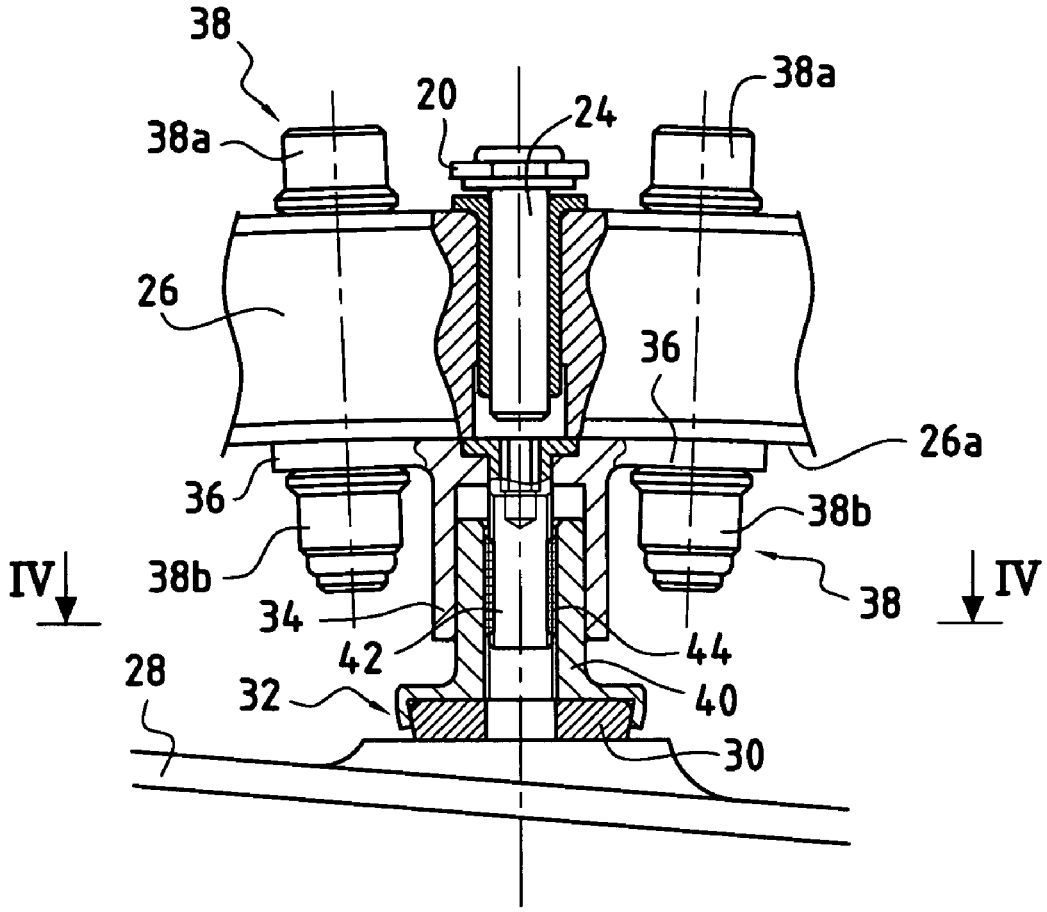
FIG. 3 is a section view of an adjustment device in another embodiment of the invention.
Figure 4:
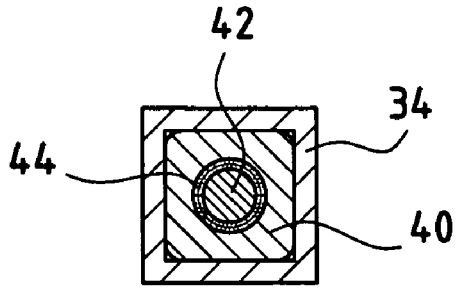
FIG. 4 is a section view on IV-IV of FIG. 3.

There follows a description of an embodiment of the device of the invention as shown in FIGS. 3 and 4. Elements in common with the device shown in FIG. 2 are identified by the same references and are therefore not described again.

Compared with the above-described embodiment, the tubular portion 34 of the pad carrier 32 that extends longitudinally from the control ring 26 towards the inside thereof and that terminates in the two fastener flanges 36, is suitable for receiving a complementary tubular portion 40 of the pad 30, e.g. receiving it slidably. In this situation, the pad 30 is crimped to the free end of the tubular portion 40.

The device further includes a screw 42 for screwing into the tubular portion 40 of the pad 30 in such a manner as to enable its radial position to be adjusted. For this purpose, the tubular portion 40 of the pad 30 presents internal tapping (not shown in the figures) complementary to the thread of the screw.

The adjustment screw 42 extends longitudinally from the control ring 26 towards the inside thereof. As shown in FIG. 3, the head of the screw 42 is thus held captive between the inside surface 26*a* of the ring 26 and the tubular portion 34 of the pad carrier 32.

Means for locking the adjustment screw 42 in the pad 30 are also provided in order to ensure that its radial position is locked.

In the example shown in FIGS. 3 and 4, these locking means are in the form of a self-braking bushing 44 interposed between the screw 42 and the tubular portion 40 of the pad 30. Alternatively, these locking means could be constituted by an elliptical deformation of the tapping or of an additional self-braking thread or of any other known means for braking a screw in a tapped passage.

According to an advantageous characteristic of the invention, the tubular portions 34, 40 respectively of the pad carrier 32 and of the pad 30 present respective right sections that are substantially polygonal so as to prevent the pad 30 from turning in the pad carrier 32.

In the example of FIG. 4, these right sections are thus substantially square in shape. Alternatively, they could be rectangular, triangular, hexagonal, etc.

The radial position of the pad 30 relative to the circular surface 28 is adjusted as follows. The device is initially secured under the control ring 26 by means of attachment systems 38. By tightening the screw 42 to a greater or lesser extent in the tubular portion 40 of the pad, the tubular portion 40 is caused to slide (without turning) in the stationary tubular portion 34 of the pad carrier 32.

Under the effect of the screw action, the pad 30 can thus be moved radially relative to the circular surface 28. The self-braking bushing 44 (or any other equivalent means) then ensures that the adjustment of the screw as performed in this way is locked.

It should be observed that access to the adjustment screw 42 can be achieved either by initially separating the control lever 20 and the crank pin 24 associated therewith when the pad carrier 32 is disposed radially in line therewith (as shown in FIG. 3), or else directly through a passage provided in the ring (a configuration not shown in the figures).

Figure 5:
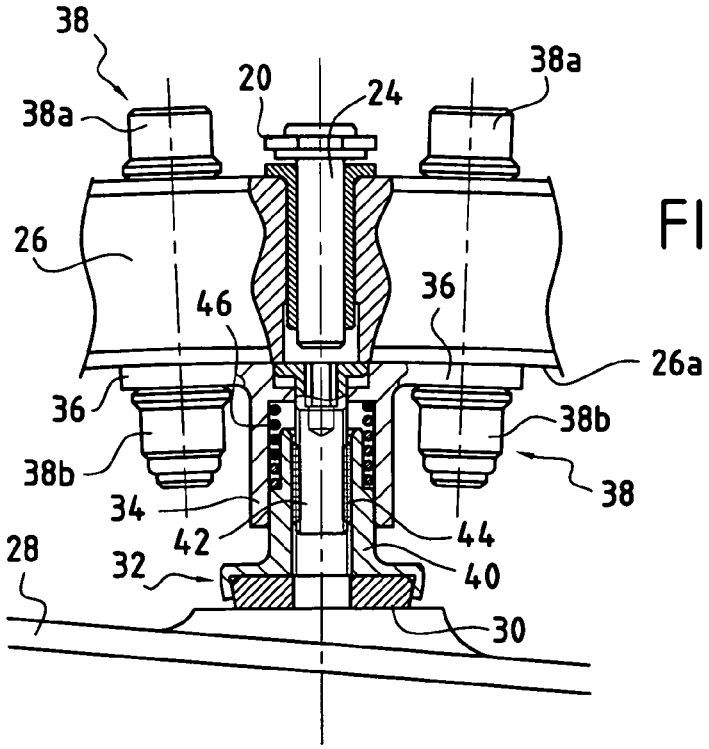
FIG. 5 is a section view of an adjustment device in yet another embodiment of the invention.

There follows a description of the embodiment of the invention shown in FIG. 5. Elements in common with the device of FIGS. 3 and 4 are identified with the same references and are therefore not described again.

Compared with the embodiment described above, the device for adjusting the centering of the control ring further includes a spring 46 that is interposed between the respective tubular portions 34 and 40 of the pad carrier 32 and of the pad 30.

The presence of such springs 46 in the assembly of the control ring 26 has the effect of damping the pads 30 against the circular surface 28.

By means of such springs, it is possible to damp the vibration that occurs in the control ring 26 and that is transmitted to the pads 30. As a result, adding a spring between the pad carrier and the pad makes it possible to ensure uninterrupted contact between the circular surface 28 and the pads 30 during the various stages of turbomachine operation.

What is claimed is:

1. A device for adjusting the centering of a control ring for pivoting vanes of a turbomachine, the device comprising a plurality of pads for coming into contact with a circular surface that is coaxial with the ring, each pivoting vane being connected to the control ring via a lever having a first end secured to the control ring via a crank pin disposed radially on said ring, and a second end mounted on a pivot of the vane, each of said pads being secured to a pad carrier, wherein each pad carrier is secured under the control ring by attachment systems that are designed to be assembled from over the rings, wherein the pad carrier includes a substantially tubular portion extending longitudinally from the control ring towards the inside thereof and suitable for receiving a complementary tubular portion of the pad, the device further including a screw for screwing into the complementary tubular portion of the pad in such a manner as to enable the radial position of the pad to be adjusted.

2. A device according to claim 1, further including means for adjusting the radial positions of the pads.

3. A device according to claim 1, further including means for locking the pad against turning relative to the pad carrier.

4. A device according to claim 3, wherein the respective tubular portions of the pad carrier and of the pad present respective right sections that are substantially polygonal so as to prevent the pad from turning in the pad carrier.

5. A device according to claim 1, further including means for locking the adjustment screw in the pad.

6. A device according to claim 1, wherein each pad carrier is disposed radially in line with the crank pin of the vane with which it is associated.

7. A device according to claim 1, wherein each attachment system comprises a screw for screwing into the control ring from the outside thereof, and a clamping nut.

8. A stage of stator vanes of a compressor comprising at least one device according to claim 1.

9. A turbomachine comprising at least one device according to claim 1.

10. A device for mounting a pad on a control ring of a turbomachine, the device comprising:

a pad;

a pad carrier, wherein said pad is secured to said pad carrier;

a fastener configured to secure said pad carrier under the control ring, said fastener having a portion extending over said control ring when said pad carrier is secured under said control ring; and a spring interposed between the pad carrier and the pad so as to provide damping for the pad.

11. A device for mounting a pad on a control ring of a turbomachine, the device comprising:

a pad;

a crank pin disposed radially on said control ring;

a pad carrier, wherein said pad is secured to said pad carrier;

a fastener configured to secure said pad carrier under the control ring, said fastener having a portion extending over said control ring when said pad carrier is secured under said control ring, wherein the pad carrier is secured to the control ring with two attachment systems that are disposed symmetrically on either side of the crank pin.

12. A device for mounting a pad on a control ring of a turbomachine, the device comprising:

a pad;

a crank pin disposed radially on said control ring;

a pad carrier coupled to said pad, said pad carrier being positioned between said control ring and said pad, said pad carrier comprising two flanges disposed symmetrically on either side of the crank pin; and two fasteners configured to secure said pad carrier to the control ring, each of said two fasteners extending through one of said two flanges of said pad carrier and through said control ring so that each of said two fasteners has a first free end on a side of said control ring and a second free end on another side of said control ring, said second free end being positioned between said control ring and said pad.

13. A device according to claim 12, wherein said two fasteners are not coaxial with said pad carrier.

14. A device according to claim 12, wherein said pad carrier is coaxial with said crank pin, and said fasteners are not coaxial with said pad carrier.

15. A device according to claim 12, further comprising a spring interposed between the pad carrier and the pad.

16. A device according to claim 12, further comprising a screw, and wherein said pad includes a hollow tubular portion, said screw extending from said control ring and into said hollow tubular portion of said pad.

17. A device according to claim 16, wherein said screw has a head located between said control ring and said pad.

* * * * *